United States Patent [19]

Best et al.

[11] 4,350,953

[45] Sep. 21, 1982

[54] TIME INTERVAL MEASUREMENT APPARATUS

[75] Inventors: Allan I. Best; Thomas K. Bohley; Ronald C. Westlund, all of Colorado Springs, Colo.

[73] Assignee: Hewlett-Packard Company, Palo Alto, Calif.

[21] Appl. No.: 888,094

[22] Filed: Mar. 20, 1978

[51] Int. Cl.[3] ..... G04F 8/00

[52] U.S. Cl. ..... 324/183; 324/121 R

[58] Field of Search ..... 324/121 R, 185

[56] References Cited

U.S. PATENT DOCUMENTS

| | | | |
|---|---|---|---|
| 3,551,733 | 12/1970 | Johnson | 324/121 R |
| 3,975,684 | 8/1976 | Mordan | 324/185 |
| 4,034,291 | 7/1977 | Allen | 324/121 R |
| 4,065,664 | 12/1977 | Kristof | 324/121 R |

*Primary Examiner*—Michael J. Tokar

*Attorney, Agent, or Firm*—Michael L. Sherrard

[57] ABSTRACT

A triggerable oscilloscope having a digital clock selectably connected to two digital counters accurately measures a time interval between two recurring events. The first digital counter is connected to the digital clock to count clock pulses during a timer interval between the initiation of a horizontal sweep signal and the occurrence of the first recurring event. A second digital counter is connected to the digital clock to count clock pulses during a time interval between the initiation of a sequent horizontal sweep signal and the occurrence of the second recurring event. A subtractor circuit coupled to the first and second digital counters subtracts the count of the first digital counter from the count of the second digital counter and determines the time interval between the first and second recurring events.

Time averaging techniques increase the accuracy of the time interval measurements for high speed recurring events by accumulating counts during a plurality of horizontal sweep signals. Predivide techniques are used for low speed recurring events to limit the number of counts accumulated during a horizontal sweep signal to a number compatible with the capacity of the digital counters.

9 Claims, 8 Drawing Figures

TIME INTERVAL MEASUREMENT APPARATUS

BACKGROUND OF THE INVENTION

Prior art, dual-delayed sweep oscilloscopes have two positionable markers on a display. Each marker may be positioned to coincide with the display of one of the two recurring events. The markers are selectively positioned by adjusting first and second controls which vary the levels of first and second reference voltages, respectively. A comparator compares one of the variable reference voltages to a horizontal sweep signal during alternate horizontal sweep signals and when the level of the horizontal sweep signal exceeds the level of the variable reference voltage, the intensity of the display is increased to define the positionable marker. Since the level of the horizontal sweep signal increases linearly with time, the time interval between the initiation of the horizontal sweep signal and each recurring event can be determined by dividing the level of each reference voltage by the slope of the horizontal sweep signal. The time interval between the two recurring events is determined by dividing the difference between the levels of the two reference voltages by the slope of the horizontal sweep signal.

The accuracy of the prior art oscilloscopes is limited by the accuracy of the calibration of the slope of the horizontal sweep signal, non-linearities in the horizontal sweep signal, and by errors in measuring the difference between the levels of the two reference voltages.

Further, due to noise in the circuitry which generates the horizontal sweep signal, the comparator is susceptible to triggering on the noise instead of the horizontal sweep signal when a low level reference voltage is selected. Unpredictable triggering of the comparator as a result of this noise susceptibility causes instability of the marker position and errors in the time measurement. Further still, the leading portion of the horizontal sweep signal is typically non-linear which causes additional errors in measuring time intervals associated with low level reference voltages. To avoid these problems, prior art oscilloscopes typically establish a minimum level for the variable reference voltages. However, the use of a minimum level for the variable reference voltages results in a time interval subsequent to the initiation of the horizontal sweep signal in which positionable markers cannot be positioned. Therefore, prior art oscilloscopes cannot make time measurements in this time interval.

Finally, the prior art does not provide any method for measurement of the time interval between two triggered events. The prior art merely teaches a method for manually positioning intensified markers to coincide with desired events and for determining the time interval between the manually positioned markers.

A typical prior art oscilloscope is described in detail in U.S. Pat. No. 3,975,684, entitled SWEEP GENERATOR APPARATUS AND METHOD issued to William J. Mordan on Aug. 17, 1976.

SUMMARY OF THE INVENTION

The preferred embodiment of the present invention incorporates two trigger generators, two digital counters and a digital reference clock in an improved apparatus for measuring a time interval between recurring first and second events. A main trigger generator is coupled to a horizontal sweep generator and generates a main trigger signal which causes the horizontal sweep generator to generate a horizontal sweep signal. The main trigger signal also causes the digital reference clock to be coupled to the first digital counter and causes a first enabling signal to be provided to a delayed trigger generator. A comparator coupled to the horizontal sweep generator provides a second enabling signal to the delayed trigger generator in response to the level of the horizontal sweep signal exceeding a first reference voltage. Receipt of the first and second enabling signals enables the delayed trigger generator. Once enabled, the delayed trigger generator generates a delayed trigger signal corresponding to the first event in response to a synchronization signal meeting selected trigger conditions. Occurrence of the delayed trigger signal causes the first digital counter to be decoupled from the reference clock. The first digital counter now contains a count proportional to the number of reference clock pulses occurring between the main trigger signal and the first event.

During the sequent horizontal sweep signal, the main trigger signal causes the reference clock to be coupled to the second digital counter. The comparator and delayed trigger generator operate as above except that the level of the horizontal sweep signal must exceed the level of the second reference voltage before the comparator provides the second enabling signal to the delayed trigger generator. Similarly, generation of a delayed trigger signal corresponding to the second event causes the second digital counter to be decoupled from the clock. The second digital counter now contains a count proportional to the number of reference clock pulses occurring between the main trigger signal and the second event. The difference between the counts of the two digital counters provides a measurement of the time interval between the first and second events.

The present invention overcomes several disadvantages found in the prior art. The time interval measurement is independent of the calibration of the slope of the horizontal sweep signal and the measurement of the analog values of the first and second reference voltages. Thus, the present invention is more accurate than the prior art oscilloscopes. Further, the delayed trigger generator is enabled in response to the main trigger signal which reduces the time during which the comparator is susceptible to triggering on noise. Thus, the markers can be positioned anywhere on the display without an instability in the marker position. The present invention can therefore measure time intervals subsequent to the initiation of the horizontal sweep signal. Finally, the time interval measurement is dependent upon the sensing of trigger signals rather than manually positioned markers. Thus, the time interval between two events can be measured without the inherent inaccuracies attendant time measurements dependent on manually positioned markers.

DETAILED DESCRIPTION OF THE PREFERRED EMBODIMENT

Figure 1:
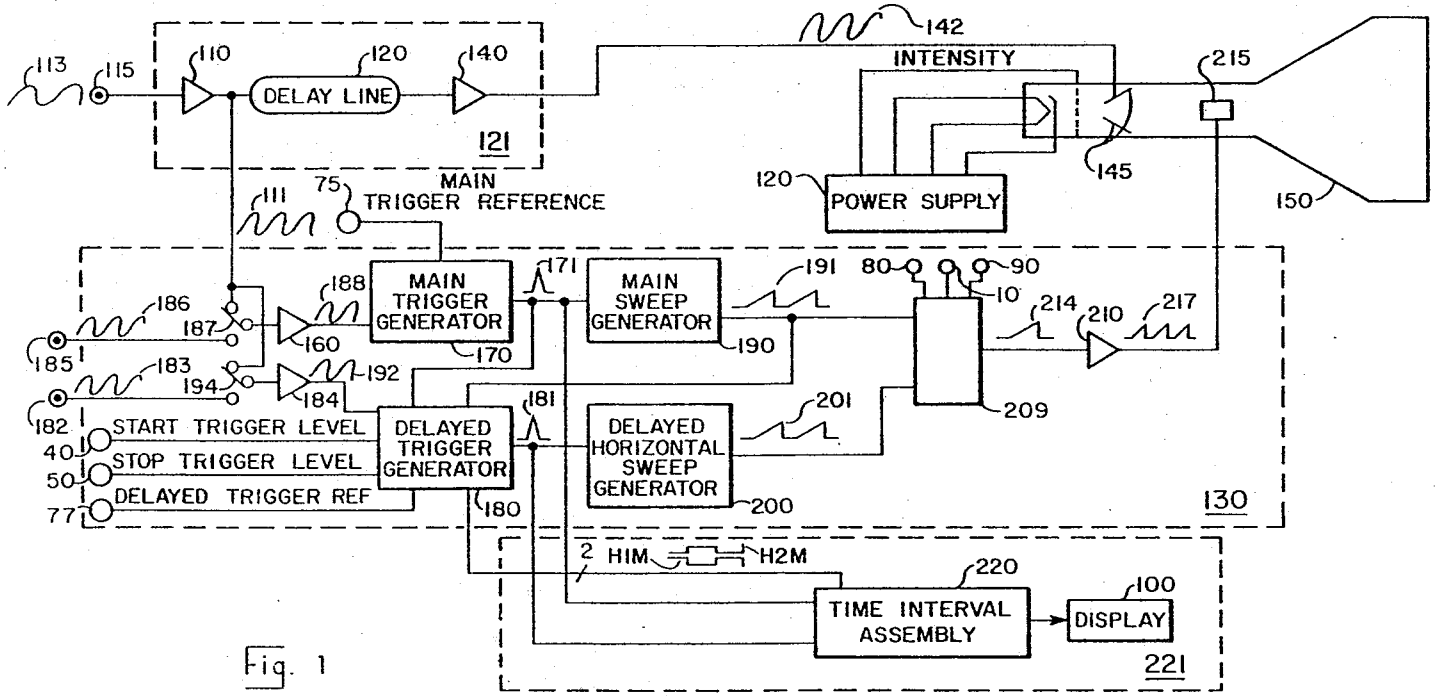
FIG. 1 is a block diagram of an oscilloscope constructed in accordance with the preferred embodiment.

FIG. 1 is a block diagram of an oscilloscope constructed in accordance with the preferred embodiment of the invention having an input 115 for receiving a vertical deflection signal 113 to be displayed. This signal may include two recurring events which are spaced apart an unknown time interval in each recurrence which is desirable to determine. A vertical deflection circuit 121 is coupled to the input 115 for receiving vertical deflection signal 113. Vertical deflection circuit 121 and a horizontal sweep generating circuit 130 are coupled to a cathode ray tube 150 for displaying vertical deflection signal 113. A time interval assembly 221 is coupled to horizontal sweep generating circuit 130 for providing a measurement of the time interval between the two recurring events.

Vertical deflection circuit 121 has input 115 coupled to the input of a vertical preamplifier 110 for providing deflection signal 113 to vertical preamplifier 110. Vertical preamplifier 110 comprises circuitry for selectively coupling and amplifying deflection signal 113 in response to controls 7 on a front panel 5 illustrated in FIG. 2. Vertical preamplifier 110 is coupled through a delay line 120 and vertical output amplifier 140 to provide a vertical deflection signal 142 to vertical deflection plates 145 of cathode ray tube 150.

A selector 187 is coupled to receive an internal synchronization signal 111 from vertical preamplifier 110 and an external synchronization signal 186 applied to a terminal 185 for providing a selected one of the synchronization signals to a synchronization amplifier 160. Synchronization amplifier 160 couples selected synchronization signal 188 to a main trigger generator 170.

Main trigger generator 170 is also coupled to a trigger level control 75 for receiving a selectable main trigger reference signal therefrom. When the level of selected synchronization signal 188 exceeds the level of the main trigger reference signal, main trigger generator 170 generates a main trigger signal 171.

A delayed selector 194 is coupled to receive internal synchronization signal 111 from vertical preamplifier 110 and a delayed external synchronization signal 183 applied to a terminal 182 for providing a selected one of the synchronization signals to a delayed synchronization amplifier 184. Delayed synchronization amplifier 184 couples selected delayed synchronization signal 192 to a delayed trigger generator 180.

As described in further detail below, delayed trigger generator 180 is connected to receive main trigger signal 171 from main trigger generator 170, selected delayed synchronization signal 192 from delayed synchronization amplifier 184, a start trigger level signal selected by a start control 40, a stop trigger level signal selected by a stop control 50, a delayed trigger reference signal selected by a delayed trigger level control 77, and a main horizontal sweep signal 191 from a main horizontal sweep generator 190. During alternate main horizontal sweep signals 191, delayed trigger generator 180 compares first the start trigger level signal and then the stop trigger level signal to the main horizontal sweep signal 191. When main horizontal sweep signal 191 attains a level greater than the levels of the start and stop trigger level signals, the delayed trigger generator 180 generates first and second delayed trigger signals respectively.

Figure 2:
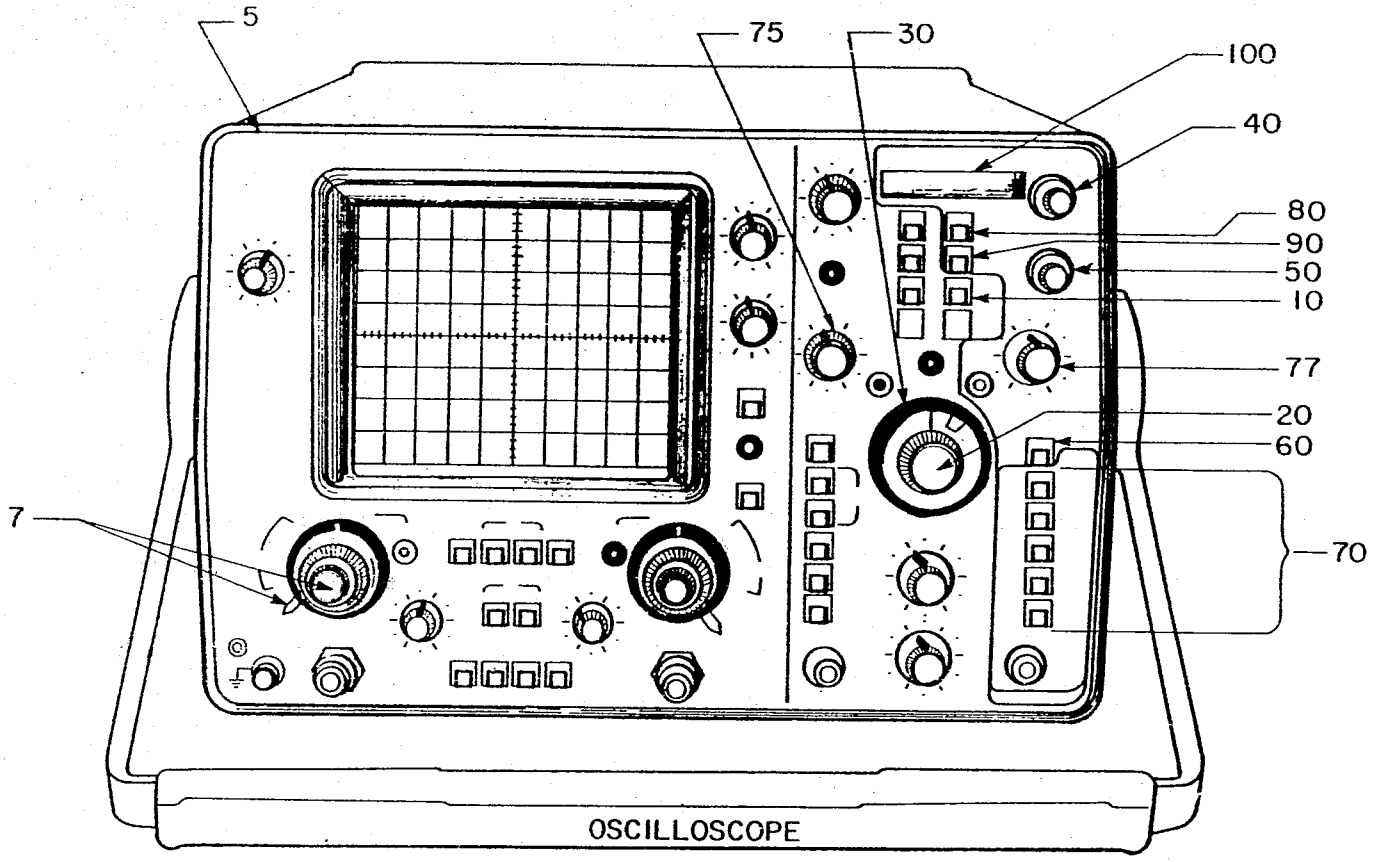
FIG. 2 is an illustration of the front panel of the oscilloscope of FIG. 1.
Figure 3:
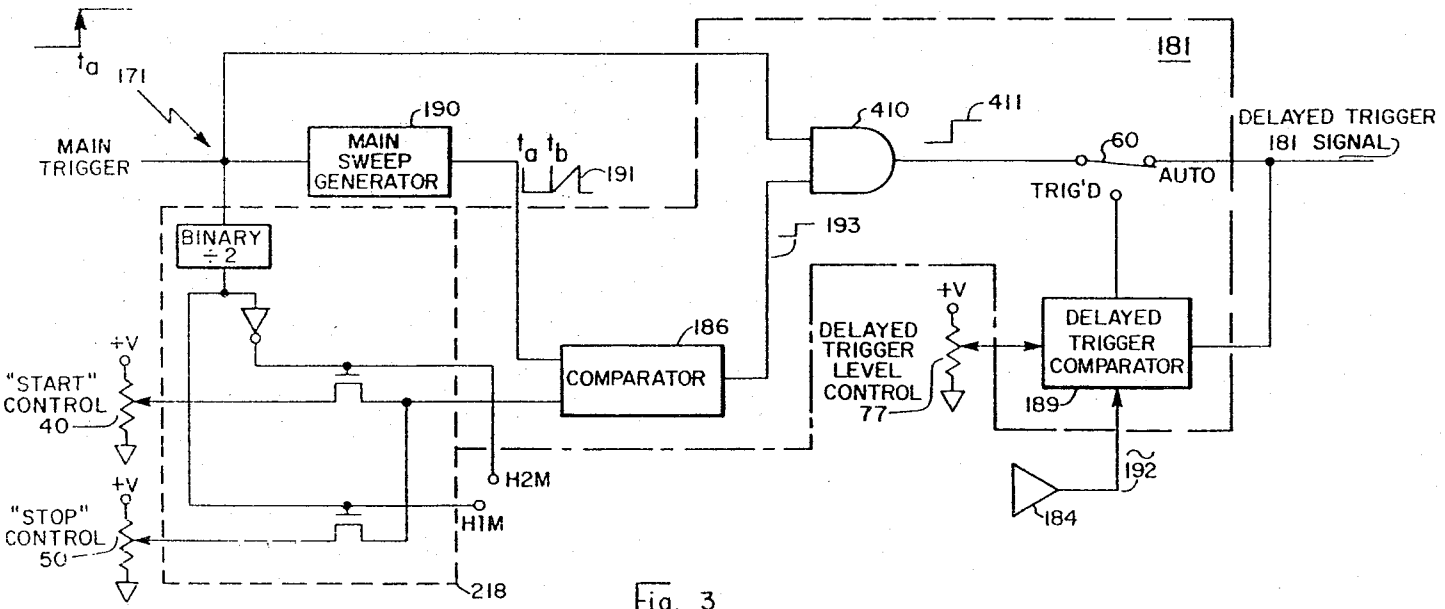
FIG. 3 is a more detailed block diagram of the delayed trigger generator of FIG. 1.

The delayed trigger generator 180 is operable in one of two modes selected by a mode control 60 shown in FIG. 2. A more detailed block diagram of delayed trigger generator 180 in an AUTO mode configuration is illustrated in FIG. 3. During operation of delayed trigger generator 180, main trigger signal 171 is applied to main horizontal sweep generator 190 and to an AND gate 410. After a start up time delay ($t_b - t_a$) main sweep generator 190 generates main horizontal sweep signal 191. A comparator 186 is coupled to main sweep generator 190 and to trigger level signal selector 218 to receive horizontal sweep signal 191 and one of the two trigger level signals. Trigger level signal selector 218 is coupled to receive main trigger signal 171 and alternately provides first the start control trigger level signal and then the stop control trigger level signal to comparator 186 during sequential horizontal sweep signals 191. When the level of horizontal sweep signal 191 exceeds the trigger level signal being compared, comparator 186 generates a comparison signal 193 and causes logic gate 410 to generate and output signal 411 which is applied to mode control 60 and provides delayed trigger signal 181.

A TRIG'D mode of operation can be selected by switching mode control 60, shown in FIG. 3, to its "TRIG'D" position. In this mode of operation output signal 411 from logic gate 410 does not immediately provide delayed trigger signal 181 but rather enables a delayed trigger comparator 189. Comparator 189 receives the delayed trigger reference signal from delayed trigger level control 77 and selected delayed synchronization signal 192 from delayed synchronization amplifier 184. When the level of selected delayed synchronization signal 192 exceeds the level of the delayed trigger reference signal, delayed trigger comparator 189 generates delayed trigger signal 181. As is well understood in the art, delayed trigger comparator 189 can also be responsive to additional and/or alternative trigger signal qualifiers as indicated by controls 70 shown in FIG. 2.

A delayed horizontal sweep generator 200, shown in FIG. 1, receives delayed trigger signal 181 from delayed trigger generator 180 and generates a delayed horizontal sweep signal 201 in response thereto. The magnitudes of the slopes of main and delayed horizontal sweep signals 191 and 201 are selected by a TIME/DIV control 20 and a bezel 30 respectively, shown in FIG. 2.

The outputs of sweep generators 190 and 200 are selectively coupled to a horizontal output amplifier 210 by a sweep mode control 209. Actuation of a "Δtime" control 80 causes delayed horizontal sweep signal 201 to be applied to a horizontal output amplifier 210. Actuation of a "main" control 10 causes main horizontal sweep signal 191 to be applied to horizontal output amplifier 210. Actuation of a "mixed" control 90 causes main horizontal sweep signal 191 to be applied to horizontal output amplifier 210 until delayed trigger signal 181 occurs, at which time delayed horizontal sweep signal 201 is applied for the remainder of the sweep.

Horizontal output amplifier 210 receives selected horizontal sweep signal 214 from sweep mode control 209 and generates horizontal sweep signal 217 which is applied to horizontal deflection plates 215 of cathode ray tube 150.

A time interval assembly 220 is coupled to main and delayed trigger generators 170 and 180 for receiving an H1M signal, an H2M signal, and the main and delayed trigger signals 171 and 181 respectively. Trigger level signal selector 218, of delayed trigger generator 180 illustrated in FIG. 3, generates an H2M signal during alternate main horizontal sweep signals. The H2M signal causes the stop trigger level signal to be coupled to comparator 186 as described above. As will be described in further detail below, time interval assembly 220 is coupled to a LED display 100. The display generates a digital display representative of the desired time interval.

Three different gating configurations of the time interval assembly 220 are provided to conform the number of clock cycles gated to first and second counters 300 and 310 to the dynamic range of the counters. For sweep speeds of 0.5 milliseconds/division or faster an average mode of operation is used to accumulate counts during a number of main horizontal sweep signals. For sweep speeds of 10 milliseconds/division or slower a predivide mode of operation divides the clock pulses to reduce the number of counts applied to counters 300 and 310. For sweep speeds of 1, 2, and 5 milliseconds/-division the clock pulses are gated directly to counters 300 and 310 during a single main horizontal sweep signal. The average and predivide modes of operation are described in further detail below.

Figure 4:
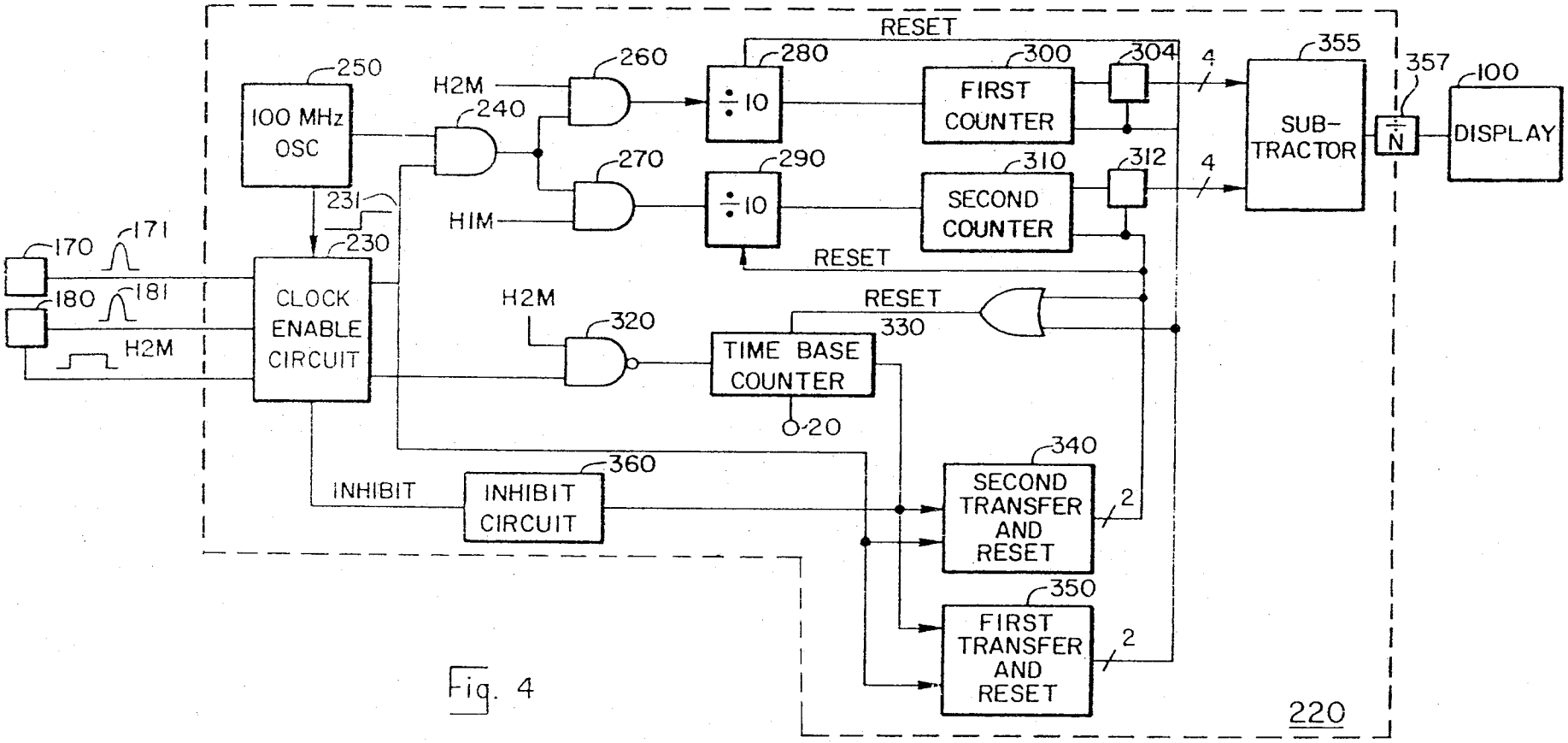
FIG. 4 is a block diagram of the time interval assembly of FIG. 1 configured to operate in an average mode.
Figure 5:
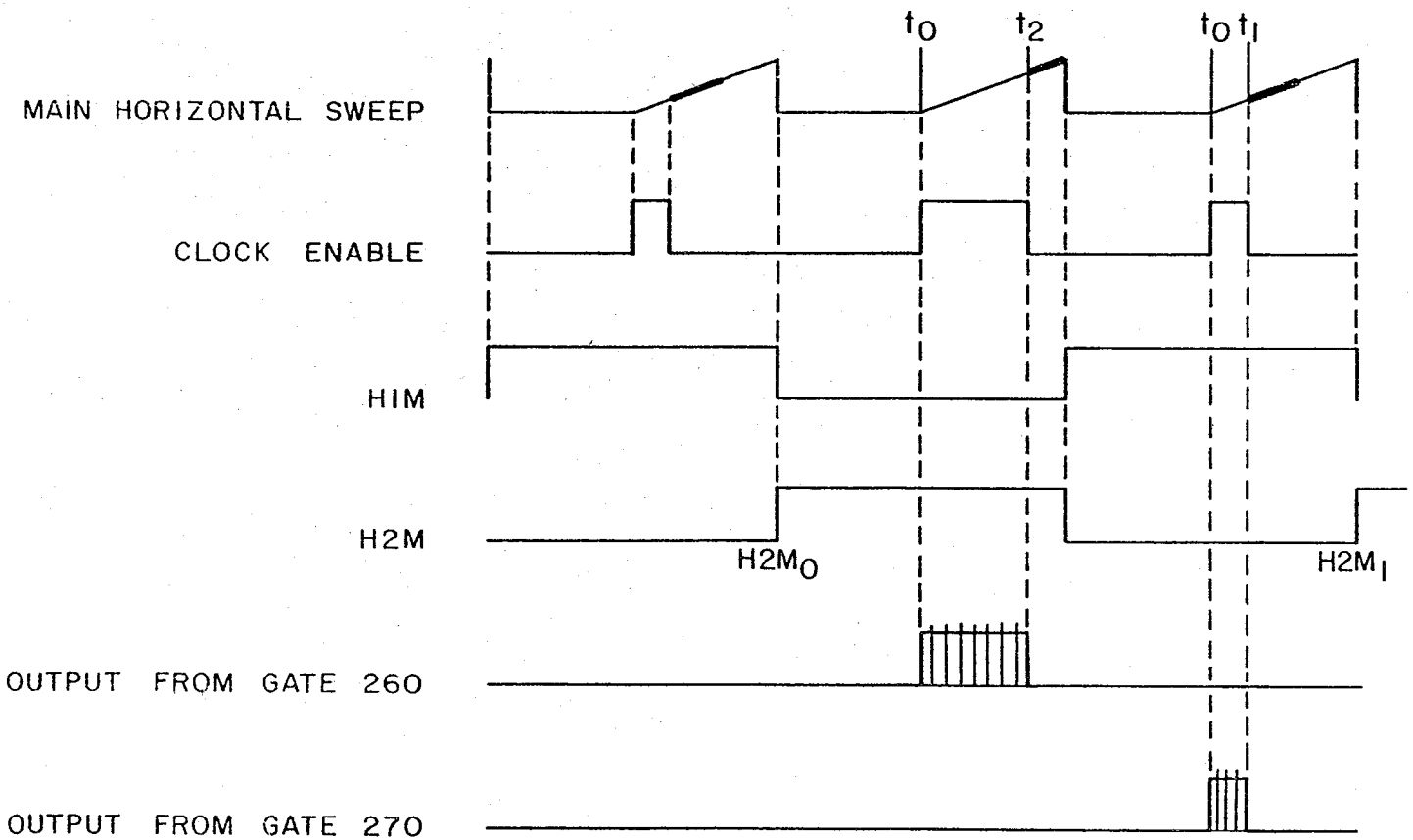
FIG. 5 is a timing diagram of selected signals associated with FIGS. 4 and 6.

The circuit configuration of time interval assembly 220 operating in the average mode is shown in FIG. 4. A clock enable circuit 230 is coupled to main trigger generator 170 and delayed trigger generator 180 for receiving main trigger signal 171, delayed trigger signal 181, and the H2M signal. Clock enable circuit 230 is also coupled to an inhibit circuit 360 for receiving an inhibit signal. Clock enable circuit 230 selectively generates a clock enable signal 231 as described in more detail below. The first clock enable signal 231 causes first and second transfer and reset circuits 350 and 340 to send signals that enable counters 300 and 310. The clock enable signal 231 is also applied to a clock gating circuit 240. When clock enable signal 231 is received, clock gating circuit 240 couples a 100 MHz crystal-controlled oscillator 250 to counter gates 260 and 270. Counter gate 260 receives the H2M signal from trigger signal level selector 218 of FIG. 2. Counter gate 270 is responsive to the H1M signal which is complementary to the H2M signal as can be seen from FIG. 5. The H2M and H1M signals cause the output from 100 MHz oscillator 250 to be gated to dividers 280 and 290 during selected time intervals illustrated in FIG. 5.

Clock enable circuit 230 is enabled by the removal of the inhibit signal generated by inhibit circuit 360. Clock enable signal 231 is generated in response to the occurrence of main trigger signal 171 at time $t_0$ and is terminated by the occurrence of delayed trigger signal 181. The delayed trigger signal 181 occurs at a time $t_1$ associated with the "start" event of the time interval to be measured. The H1M signal is provided during this time period. Thus, gate 270 passes a burst of clock pulses related to the time interval $(t_1-t_0)$.

Similarly, when signal H2M is in its high voltage state during alternate main horizontal sweep signals, delayed trigger generator 180 generates a delayed trigger signal 181 at time $t_2$, associated with the "stop" event of the time interval to be measured. Clock enable circuit 230 generates a clock enable signal 213 in response to main trigger signal 171 and terminates it in response to the delayed trigger signal 181 at time $t_2$. Gate 260 thus passes a burst of clock pulse related to the time interval $(t_2-t_0)$.

The clock pulses gated through gates 260 and 270 are applied to dividers 280 and 290 respectively. Outputs of dividers 280 and 290 are connected to first and second counters 300 and 310 respectively. Thus, a count in first counter 300 represents the time between main trigger signal 171 and the "stop" event of the time interval being measured $(t_2-t_0)$, and a count in second counter 310 represents the time between main trigger signal 171 and the "start" event of the time interval being measured $(t_1-t_0)$.

During the average mode of operation being described, counts are accumulated during a number of main horizontal sweeps to increase the number of counts accumulated in the counters 300 and 310 prior to display. The first occurring H2M positive transition ($H2M_0$) illustrated in FIG. 5, causes clock enable circuit 230, illustrated in FIG. 4, to enable a cycle gate 320. Cycle gate 320 transfers sequent H2M pulses to a time base counter 330. Upon counting a number of H2M signals selected in response to the TIME/DIV control 20, the time base counter 330 generates an overflow signal. The overflow signal causes inhibit circuit 360 to apply the inhibit signal to clock enable circuit 230 and causes first and second transfer and reset circuits 340 and 350 to apply transfer and reset signals to counters 300 and 310. The transfer and reset signals cause data to transfer from the counters to latches 304 and 312, and the counters to reset. After a short time delay, inhibit circuit 360 removes the inhibit signal from clock enable circuit 230. Thus, when averaging, counters 300 and 310 each count N bursts of clock pulses where N is a number determined by the sweep speed selected by TIME/DIV control 20. The total counts of counters 300 and 310 are subtracted one from another in a subtractor 355 and the difference is divided by N. The quotient from divider 357 is applied to and displayed by LED display 100 shown in FIG. 1.

Figure 6:
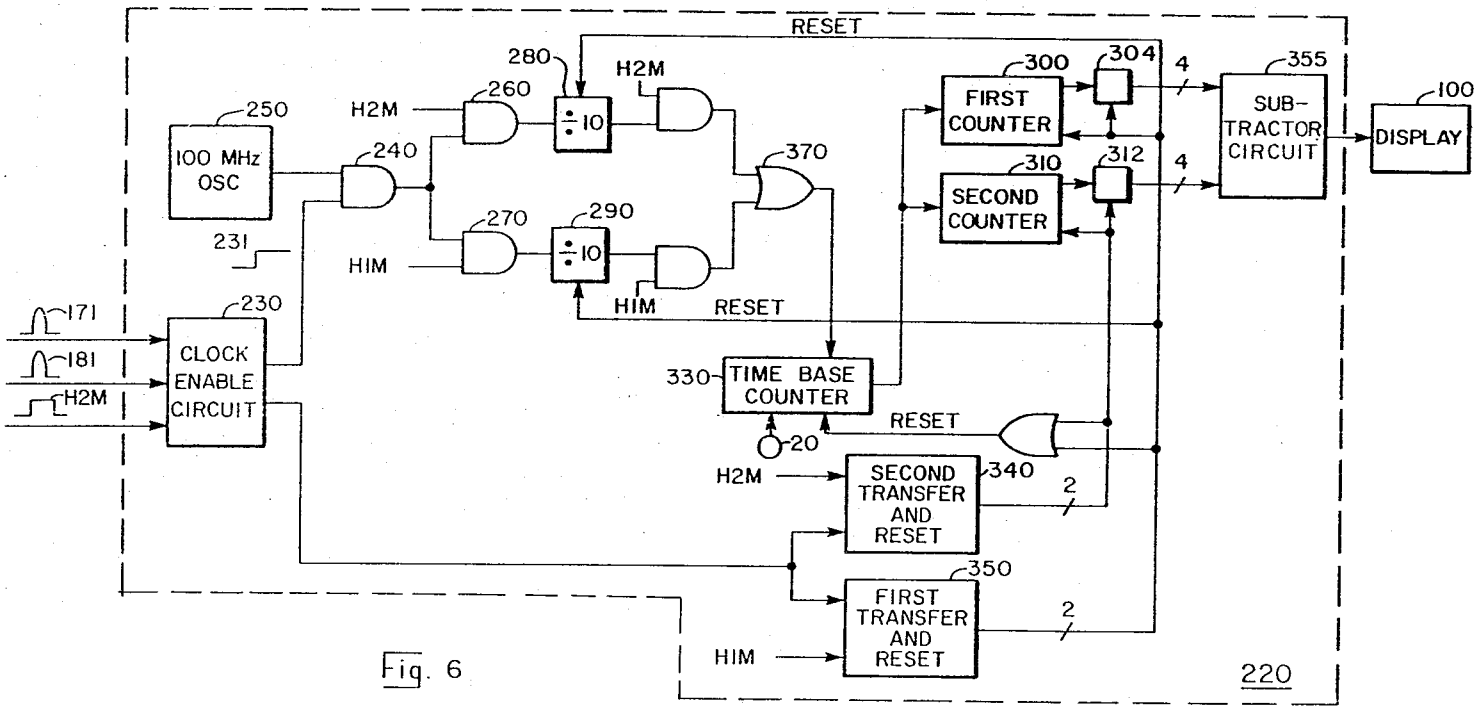
FIG. 6 is a block diagram of the time interval assembly of FIG. 1 configured to operate in a predivide mode.

In the predivide mode configuration, illustrated in FIG. 6, time base counter 330 reduces the number of clock pulses applied to the first and second counters 300 and 310. Clock pulses from dividers 280 and 290 are OR'ed by gate 370 and divided by time base counter 330 by a factor determined by TIME/DIV control 20. The divided clock pulses are applied to both first and second counters 300 and 310. The first transfer and reset circuit 350 enables first counter 300 when the H1M signal is in its low voltage state and the clock enable signal 231 is received. When the H1M signal goes to its high voltage state the count is transferred to latch 304, first counter 300 is reset and disabled, and time base counter 330 is reset. Second transfer and reset circuit 340 is responsive to the H2M signal and operates in a similar manner. The counts transferred to first and second latches 304 and 312 are coupled to subtractor circuit 355 which produces a difference between the two counts. The difference signal is applied to LED time display 100 which generates a display representative of the measured time interval.

Figure 7:
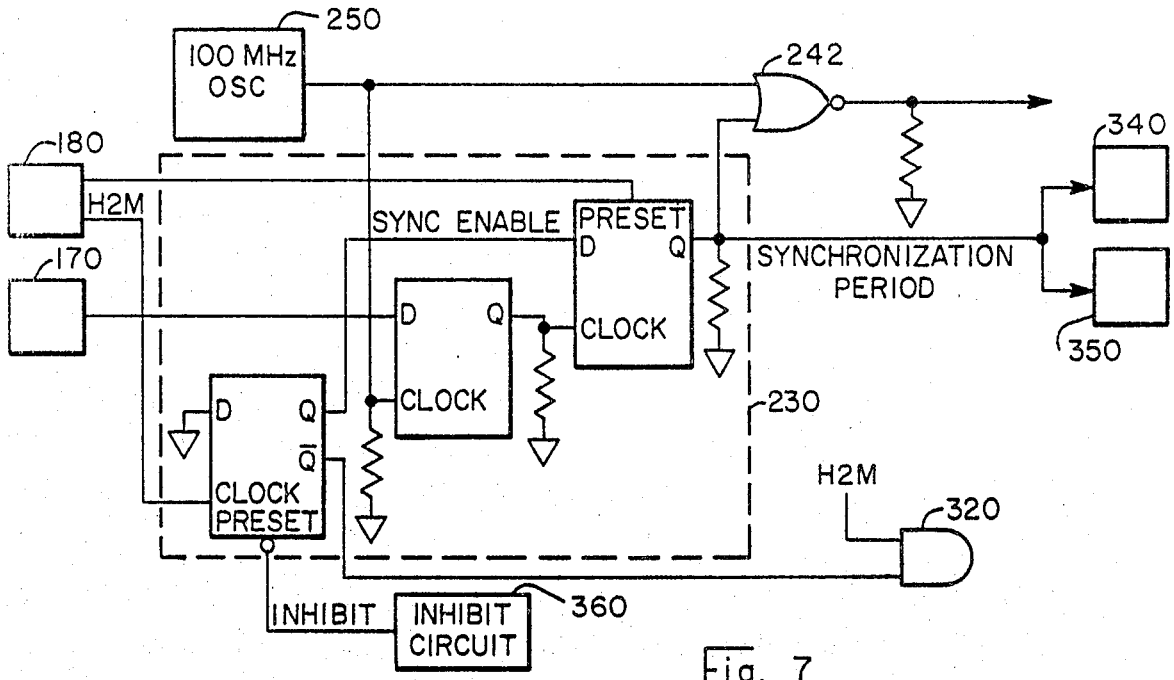
FIG. 7 is a detailed schematic diagram of the clock enable circuit.

FIG. 7 is a detailed schematic diagram of a preferred clock enable circuit 230. In this embodiment, clock gating circuit 240 is implemented as NOR gate 242. NOR gate 242 gates an inverted clock signal to counter gates 260 and 270 in response to synchronization period signal attaining a low voltage level.

Figure 8:
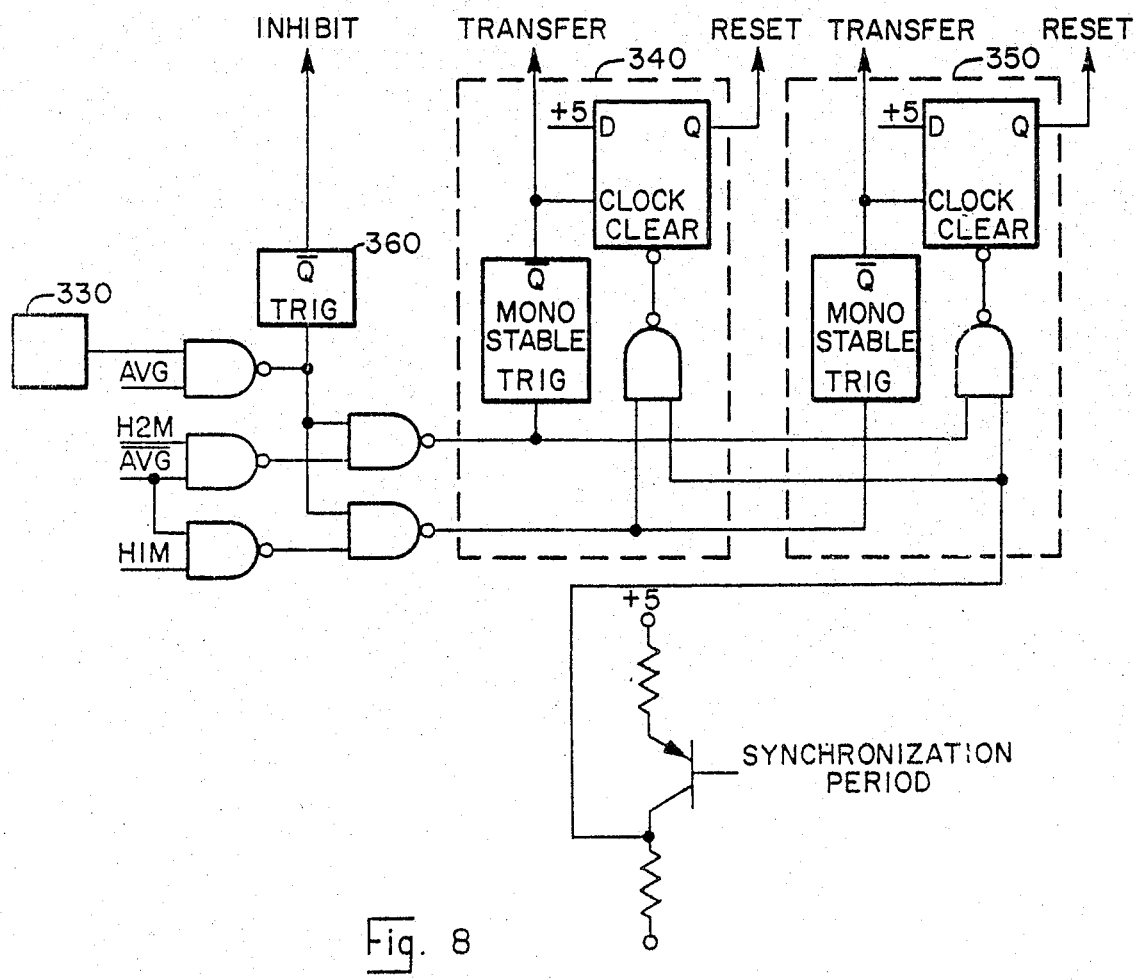
FIG. 8 is a detailed schematic diagram of the first and second transfer and reset circuits.

FIG. 8 is a detailed schematic diagram of first and second transfer and reset circuits 340 and 350. The average mode circuit configuration is selected by providing a signal on line AVG. The predivide mode configuration is selected by providing a signal on line $\overline{\text{AVG}}$.

We claim:

1. Electronic circuit apparatus comprising:

trigger means for providing first, second and third trigger signals;

main generator means coupled to said trigger means for producing a time varying sweep signal in response to the first trigger signal;

deflection means for providing a deflection signal;

display means coupled to said deflection means and to said main generator means for generating a display in response to the sweep signal and the deflection signal;

clock means for generating periodic clock signals;

processing means coupled to said clock means and to said trigger means for determining a difference count representing the difference between the number of periodic clock signals occurring during a time interval between occurrences of the first and second trigger signals and the number of periodic clock signals occurring during a time interval between occurrences of the first and third trigger signals; and digital display means coupled to said processing means for providing a digital display responsive to the difference count.

2. Electronic circuit apparatus as in claim 1 wherein said processing means further comprises:

first and second counter means, each selectively coupled to said clock means for providing first and second counts, respectively, of clock signals coupled thereto;

gating means coupled to said trigger means to said clock means and to said first and second counters for alternately coupling said clock means to one and then the other of said first and second counters in response to one and another first trigger signals, respectively, for decoupling said clock means from said first counter means in response to the second trigger signal and for decoupling said clock means from said second counter means in response to the third trigger signal; and subtractor means coupled to said first and second counter means and to said digital display means for subtracting the first count from the second count to produce the difference count.

3. Electronic circuit apparatus as in claim 2 further comprising:

input means for providing first, second and third reference signals; and wherein said trigger means is coupled to said main generator means, to said input means and to said deflection means, for generating the first trigger signal in response to the deflection signal attaining a level greater than the level of the first reference signal, generating first and second comparison signals in response to the sweep signal attaining a level greater than the levels of the second and third reference signals, respectively, and generating the second and third trigger signals in response to the first and second comparison signals respectively.

4. Electronic circuit apparatus as in claim 2 further comprising:

input means for providing first, second, third and fourth reference signals; and wherein said trigger means is coupled to said main generator means, to said input means and to said deflection means, for generating the first trigger signal in response to the deflection signal attaining a level greater than the level of the first reference signal, generating first and second comparison signals in response to the sweep signal attaining the level greater than the level of the second and third reference signals, respectively, and generating the second and third trigger signals in response to the deflection signal attaining a level greater than the level of the fourth reference signal subsequent to the occurrence of the second and third comparison signals, respectively, during a sweep signal.

5. Electronic circuit apparatus as in claim 4 wherein said input means further comprises first, second, third and fourth controls for selecting the first, second, third and fourth reference signal levels respectively.

6. Electronic circuit apparatus as in claim 3 wherein said trigger means further comprises logic means coupled to receive the first trigger signal and the first and second comparison signals, for generating the second trigger signal in response to the first trigger signal and the first comparison signal and for generating the third trigger signal in response to said first trigger signal and to the second comparison signal.

7. Electronic circuit apparatus comprising:

trigger means for providing first trigger signals;

main generator means coupled to said trigger means for producing a time varying sweep signal in response to the first trigger signals;

reference means for providing first and second reference signals;

comparison means having a first input coupled to said main generator means and further coupled to said reference means for receiving the first and second reference signals for producing a first output signal in response to the sweep signal attaining a level having a predetermined relationship relative to the level of the reference signal;

AND circuit means coupled to said comparator means to receive the first output signal, coupled to receive the first trigger signal and having an output for providing a second trigger signal at the output in response to signals appearing at both inputs; and delayed generator means coupled to the output of said second circuit means for producing a delayed time varying sweep signal in response to the second trigger signal.

8. Electrostatic circuit apparatus as in claim 7 further comprising timing means coupled to said trigger means and to said second circuit means for producing an output indication indicative of the time interval between occurrences of the first and second trigger signals.

9. Electronic circuit apparatus as in claims 7 or 8 wherein said comparison means further comprises:

selection means coupled to said trigger means and to said reference means and having an output for alternately selecting one of the first and second reference signals in response to first trigger signals and providing the selected signal at the output; and a comparator having a first input coupled to said main generator means and having a second input coupled to the output of said circuit means for producing a first output signal in response to the sweep signal attaining an amplitude greater than the amplitude of the selected signal.

* * * * *